US009376226B2

(12) United States Patent
Naitou

(10) Patent No.: US 9,376,226 B2
(45) Date of Patent: Jun. 28, 2016

(54) SEALED LETTER FORMATION SYSTEM

(71) Applicant: RISO KAGAKU CORPORATION, Tokyo (JP)

(72) Inventor: Taku Naitou, Ibaraki-ken (JP)

(73) Assignee: RISO KAGAKU CORPORATION, Tokyo (JP)

( * ) Notice: Subject to any disclaimer, the term of this patent is extended or adjusted under 35 U.S.C. 154(b) by 738 days.

(21) Appl. No.: 13/661,703

(22) Filed: Oct. 26, 2012

(65) Prior Publication Data

US 2013/0104498 A1 May 2, 2013

(30) Foreign Application Priority Data

Oct. 28, 2011 (JP) ..... 2011-236805

(51) Int. Cl.

| | |
|---|---|
| ***B65B 11/48*** | (2006.01) |
| ***B65B 61/20*** | (2006.01) |
| ***B43M 3/04*** | (2006.01) |
| ***B65B 25/14*** | (2006.01) |

(52) U.S. Cl.

CPC ..... *B65B 11/48* (2013.01); *B43M 3/045* (2013.01); *B65B 25/14* (2013.01); *B65H 2701/1916* (2013.01)

(58) Field of Classification Search

CPC ... B43M 3/045; B31B 21/00; B65H 2511/51; B65H 2701/1916; B65H 2801/78; B65H 31/34; B65H 7/00; B65H 7/20; B65H 45/00; B65H 45/04

USPC ..... 53/206, 52, 493, 569, 558, 284.3; 270/58.06; 271/2, 184, 225; 493/19, 493/20, 23, 34

See application file for complete search history.

(56) References Cited

U.S. PATENT DOCUMENTS

| | | | | |
|---|---|---|---|---|
| 3,897,720 | A * | 8/1975 | Hiersteiner | 493/216 |
| 3,965,644 | A * | 6/1976 | Stocker | B43M 3/045 270/58.06 |
| 4,091,596 | A * | 5/1978 | Jones | 53/460 |
| 4,741,147 | A * | 5/1988 | Noll | 53/505 |
| 5,137,304 | A * | 8/1992 | Silverschotz et al. | 283/100 |
| 5,154,404 | A * | 10/1992 | Lee, Jr. | B43M 3/045 270/58.06 |
| 5,220,770 | A * | 6/1993 | Szewczyk et al. | 53/493 |
| 5,388,388 | A * | 2/1995 | Belec et al. | 53/460 |
| 5,415,068 | A * | 5/1995 | Marzullo | 53/492 |
| 5,426,915 | A * | 6/1995 | Davidov | 53/411 |
| 5,568,717 | A * | 10/1996 | Harrod | 53/429 |
| 5,596,861 | A * | 1/1997 | Preston et al. | 53/52 |
| 5,913,796 | A * | 6/1999 | Emigh | 53/284.3 |
| 5,982,129 | A * | 11/1999 | Belec et al. | 318/597 |
| 6,076,336 | A * | 6/2000 | Cross | 53/452 |

(Continued)

FOREIGN PATENT DOCUMENTS

JP 2005-67724 A 3/2005

*Primary Examiner* — Stephen F Gerrity
*Assistant Examiner* — Eyamindae Jallow
(74) *Attorney, Agent, or Firm* — Greenblum & Bernstein, P.L.C.

(57) ABSTRACT

A sealed letter formation system folds an envelope sheet while enclosing a content, forms an envelope having the content enclosed therein, and seals the envelope. The sealed letter formation system includes a folder and a positioner. The folder folds the envelope sheet at only one place before enclosing the content. The positioner is provided downstream in a conveying direction of the folder to position the envelope sheet in a conveyance perpendicular direction perpendicular to the conveying direction of the envelope sheet before folding the envelope sheet while enclosing the content.

3 Claims, 6 Drawing Sheets

(56) References Cited

U.S. PATENT DOCUMENTS

| | | | | |
|---|---|---|---|---|
| 6,155,031 | A * | 12/2000 | Ballestrazzi et al. | 53/569 |
| 6,266,944 | B1 * | 7/2001 | Consiglio | 53/429 |
| 7,260,921 | B2 * | 8/2007 | Stemmle | 53/460 |
| 7,475,522 | B2 * | 1/2009 | Ponti | 53/381.5 |
| 7,565,788 | B2 * | 7/2009 | Stemmle et al. | 53/429 |
| 8,191,338 | B2 * | 6/2012 | Hagemann | B43M 3/045 270/58.06 |
| 8,215,629 | B2 * | 7/2012 | Ifkovits | G03G 15/6594 270/52.02 |
| 8,234,845 | B2 * | 8/2012 | Fairweather et al. | 53/460 |
| 2002/0112453 | A1 * | 8/2002 | Rivenbark et al. | 53/460 |
| 2007/0157578 | A1 * | 7/2007 | Fairweather et al. | 53/493 |
| 2007/0164496 | A1 * | 7/2007 | Kapturowski | B43M 3/04 270/52.01 |
| 2011/0132722 | A1 * | 6/2011 | Depoi | B65H 5/062 198/373 |

* cited by examiner

SEALED LETTER FORMATION SYSTEM

CROSS REFERENCE TO RELATED APPLICATION

This application claims benefit of priority under 35 U.S.C. §119 to Japanese Patent Application No. 2011-236805, filed on Oct. 28, 2011, the entire contents of which are incorporated by reference herein.

BACKGROUND OF THE INVENTION

1. Field of the Invention

The present invention relates to a sealed letter formation system which forms a sealed letter with a printed matter enclosed in an envelope.

2. Description of the Related Art

In recent years, a variety of sealed letter formation systems have been developed along with expanding use of sealed letters such as direct mails. A conventional, general enclosing and sealing device (see Japanese Patent Application Laid-Open Publication No. 2005-67724, for example) included in a sealed letter formation system will be described in the following.

Conventionally, in a general enclosing and sealing device, there are provided, within the device housing, a content formation unit which folds a content sheet to form a content and an envelope formation unit which folds an envelope sheet to form an envelope. A content conveyer is provided at the entrance side of the envelope formation unit. The content conveyer feeds out a content, which has been fed out from the content formation unit, toward the envelope formation unit at a preliminarily set constant feed-timing so that the content is enclosed in an envelope being folded. A sealing unit is provided at the exit side of the envelope formation unit. The sealing unit seals the envelope fed out from the envelope formation unit with the content enclosed therein.

In such an enclosing and sealing device, the content formation unit folds a content sheet to form a content, and feeds out the content toward the content conveyer. In addition, after having positioned envelope sheet in its lateral direction (a sheet-width direction perpendicular to the conveying direction), the envelope formation unit folds the envelope sheet to form an envelope, and feeds out the envelope toward the sealing unit. While the envelope formation unit is folding the envelope sheet, the content conveyer feeds out the content toward the envelope formation unit at a preliminarily set constant feed-timing, thereby to feed out the envelope enclosed with the content toward the sealing unit. Furthermore, formation of the sealed letter is completed by sealing of the envelope by the sealing unit, and whereby the sealed matter is ejected from an ejection port side and received in a container.

Typical folding modes of an envelope include a three-fold mode in which the envelope sheet is folded at two places to form a three-layer state, and a four-fold mode in which the envelope sheet is folded at three places to form a four-layer state. A conventional enclosing and sealing device usually allows switching between the three-fold and four-fold modes via an input panel or the like provided on the device.

When making the length of an envelope in the conveying direction after the envelope is folded in a three-fold mode equal to the length of an envelope in the conveying direction after the envelope is folded in a four-fold mode, the overall size of the envelope in the four-fold mode is longer in the conveying direction compared with the envelope in the three-fold mode. Accordingly, there has been a problem that the space required for lateral-direction positioning of the envelope sheet (in the sheet-width direction) increases, which may result in an increased size of the device. In addition, since the tip of the envelope sheet is used for lateral-direction positioning of the envelope sheet, the rear edge of the sheet in the four-fold mode has a poor follow-up characteristics compared with the three-fold mode. Accordingly, there has also been a problem of a prolonged processing time for positioning, which may result in a decreased productivity. In order to shorten the processing time, it is required to newly provide a mechanism for positioning of contents, which may result in further increase in size and cost of the device.

SUMMARY OF THE INVENTION

Having been made in view of the above problems, the present invention aims to provide a sealed letter formation system which can perform positioning of an envelope sheet in its width direction in a short time using a small device, when folding an envelope sheet which is relatively long in a conveying direction such as an envelope sheet in a four-fold mode.

According to a first aspect of the present invention, there is provided a sealed letter formation system that folds an envelope sheet while enclosing a content, forms an envelope having the content enclosed therein, and seals the envelope, the system comprising: a folder that folds the envelope sheet at only one place before enclosing the content; and a positioner provided downstream of the folder in the conveying direction of the envelope sheet to position the envelope sheet in a conveyance perpendicular direction perpendicular to the conveying direction of the envelope sheet before folding the envelope sheet while enclosing the content.

According to a second aspect of the present invention, the positioner includes: a feeding member that conveys the envelope sheet; a positioning driver that transfers the feeding member in the conveyance perpendicular direction; and a detector that detects that a side edge of the envelope sheet along the conveying direction of the envelope sheet has reached a predetermined position, wherein when the detector detects that the side edge of the envelope sheet has reached the predetermined position, the transfer of the feeding member by the positioning driver is stopped.

According to a third aspect of the present invention, the sealed letter formation system further comprises a switcher that feeds the envelope sheet to the positioner before enclosing the content without folding the envelope sheet by the folder, when a length of the envelope sheet in the conveying direction is relatively short.

According to the first aspect of the present invention, an envelope sheet which is relatively long in the conveying direction such as the envelope sheet in the four-fold mode is first folded, and conveyed to the positioner with the length of the envelope sheet shortened to be positioned in the conveyance perpendicular direction. Therefore, the space required for the positioner can be significantly reduced in comparison with a conventional device, and the sealed letter formation system can be downsized.

According to the second aspect of the present invention, since the position of the envelope sheet is adjusted by transfer of the feeding member in the axial direction, positioning of the envelope sheet in the conveyance perpendicular direction can be performed in a short time using simple mechanism.

According to the third aspect of the present invention, an envelope sheet which is relatively short in the conveying direction such as the envelope sheet in the three-fold mode is conveyed to the positioner without being folded, and positioned in the conveyance perpendicular direction.

DESCRIPTION OF THE EMBODIMENTS

In the following, an embodiment of the present invention will be described. Sheets of any size are applicable in the following description. Although stencil printing or inkjet printing for example, is performed in the following embodiment, printing may be performed by other methods. The printing form is not particularly limited in the present invention. The number of types of printed matter to be sealed (number of sheets of the printed matter) is also not particularly limited.

In addition, the drawings are schematic and not drawn to scale. Therefore, specific dimensional ratios should be determined taking into consideration the following description. Dimensional relations or ratios may also be different among the drawings.

The embodiment shown below is only illustrative to embody the technical idea of the invention, and the embodiment of the invention is not intended to limit the material, shape, structure, arrangement or the like of the components to those described in the following. The embodiment of the invention may be modified and implemented in various ways within a range not departing from its gist.

Figure 1:
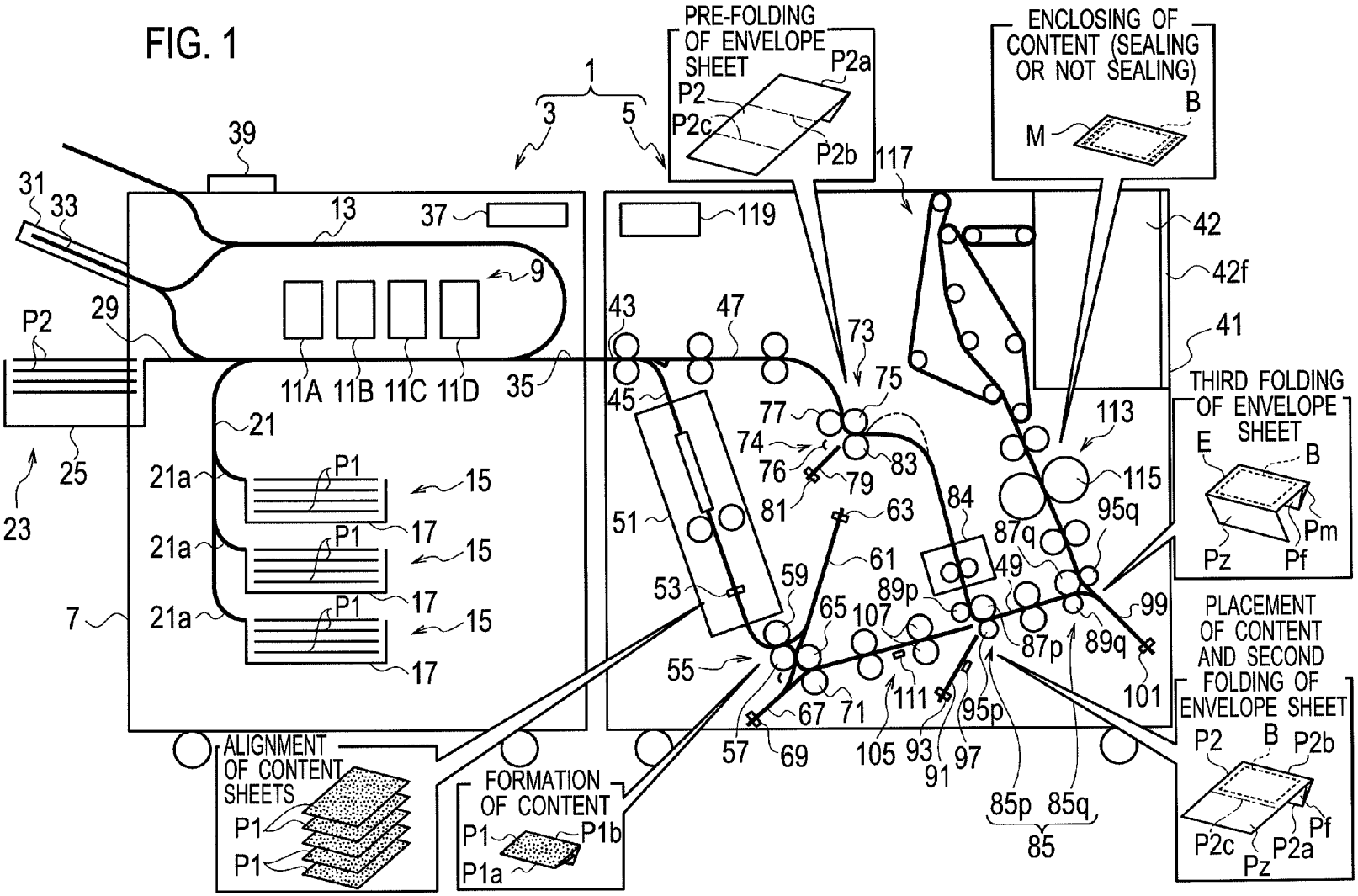
FIG. 1 is a schematic front view of a sealed letter formation system according to an embodiment of the present invention, explaining that a content sheet is sealed in an envelope sheet.
Figure 2:
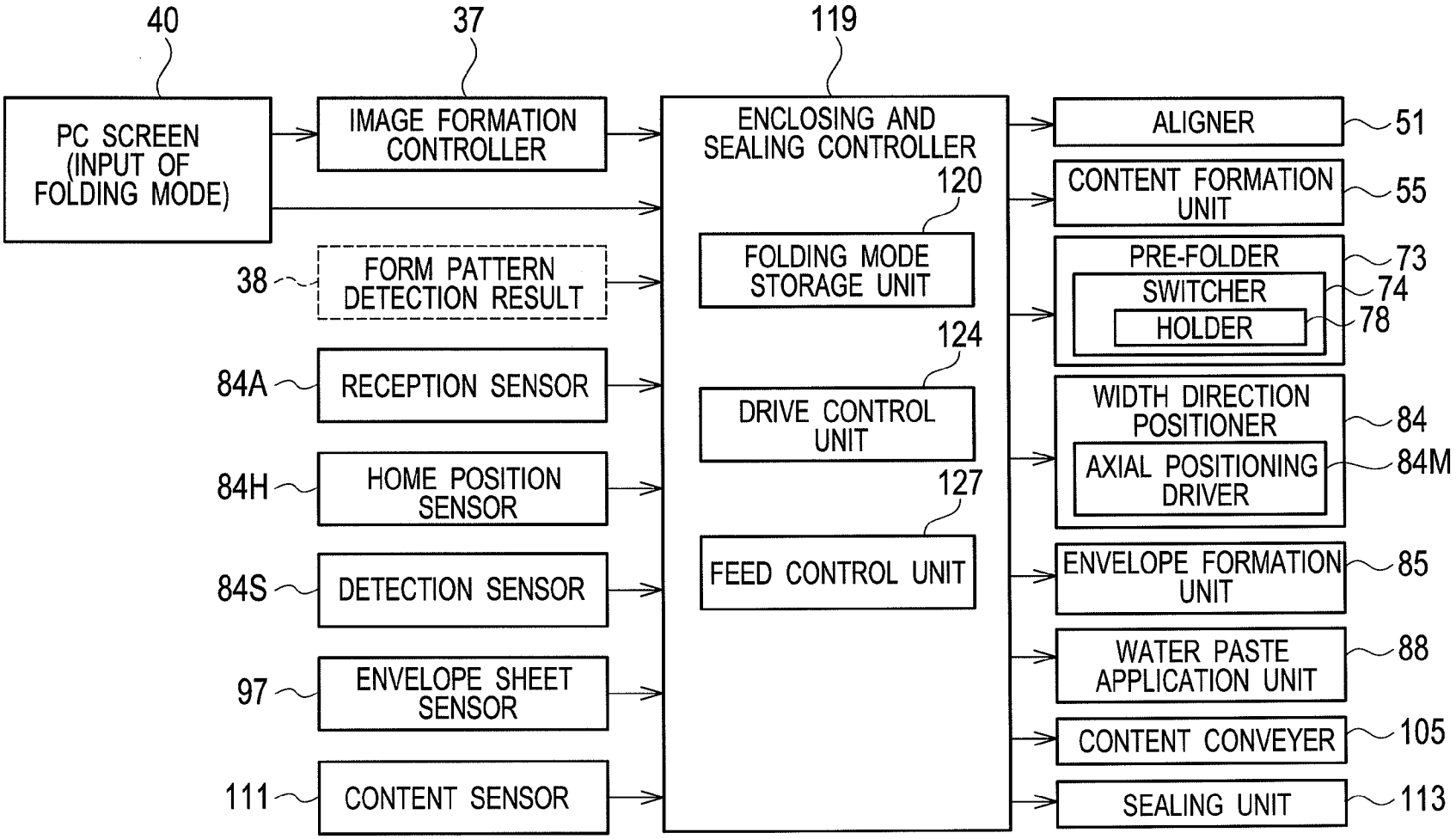
FIG. 2 is a control block diagram of the sealed letter formation system according to an embodiment of the present invention.
Figure 3:
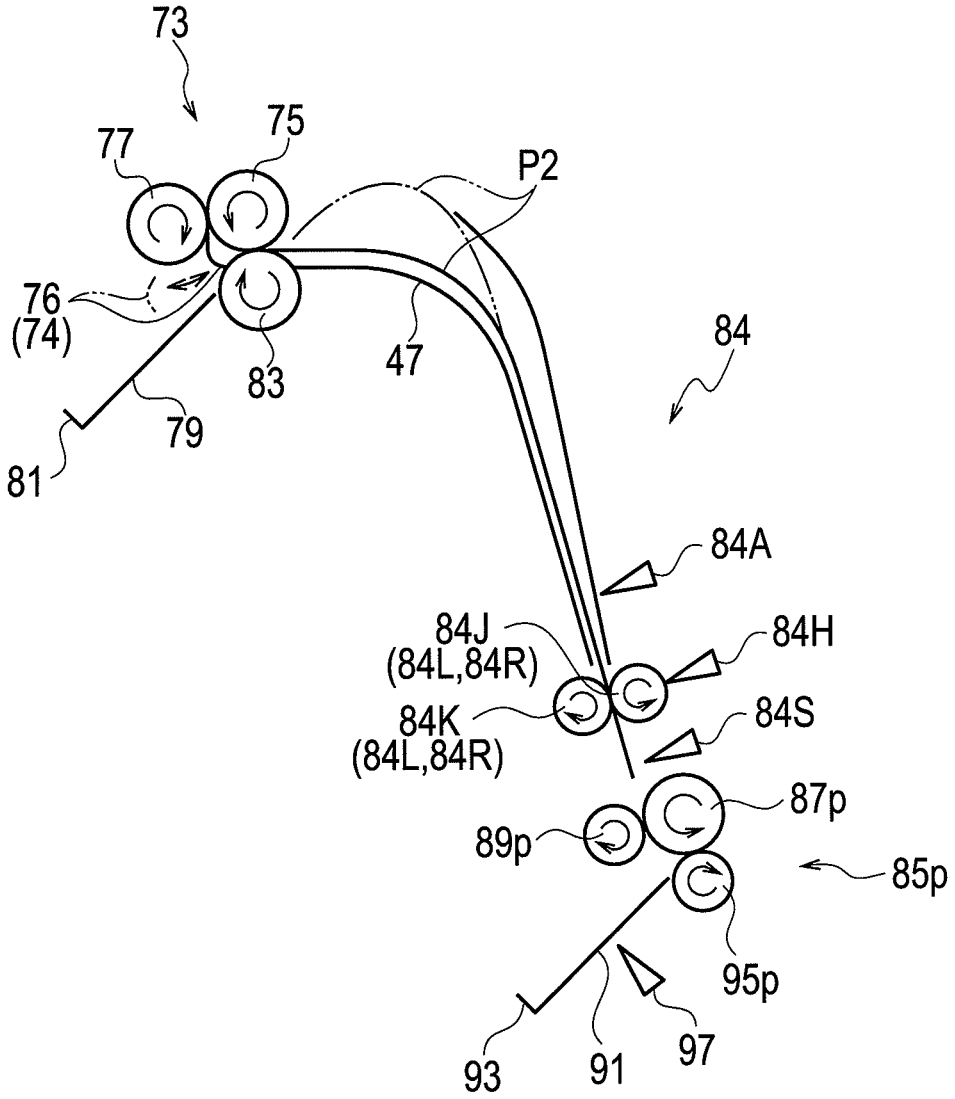
FIG. 3 is a schematic side view showing an axial positioning driver of the sealed letter formation system according to an embodiment of the present invention.
Figure 4A:
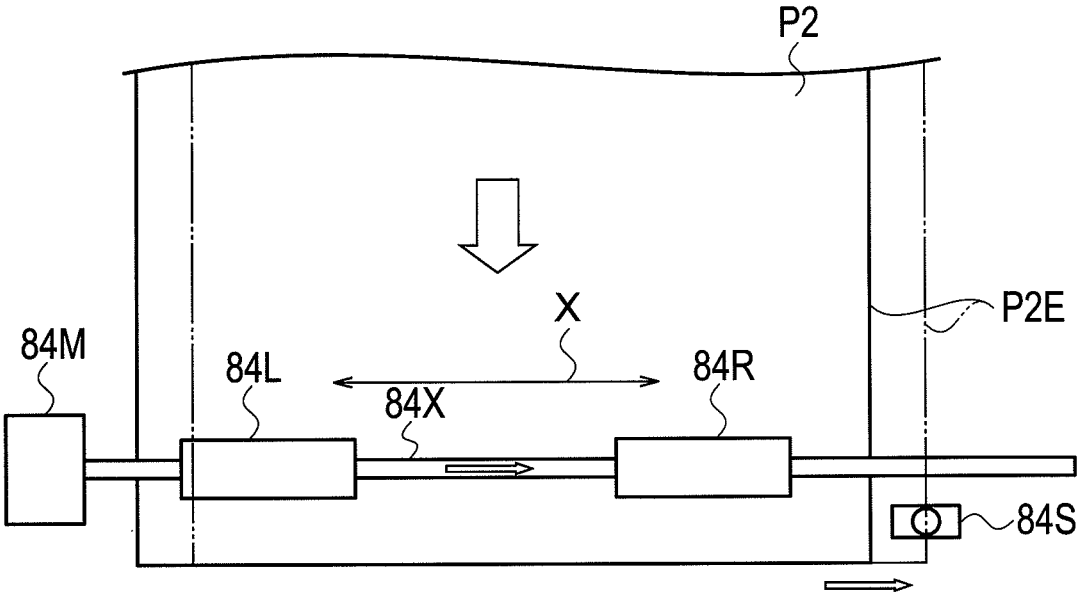
FIG. 4A is a schematic diagram of the sealed letter formation system according to an embodiment of the present invention, when seen from the plane of the envelope sheet, showing that the envelope sheet is positioned in the conveyance perpendicular direction.
Figure 4B:
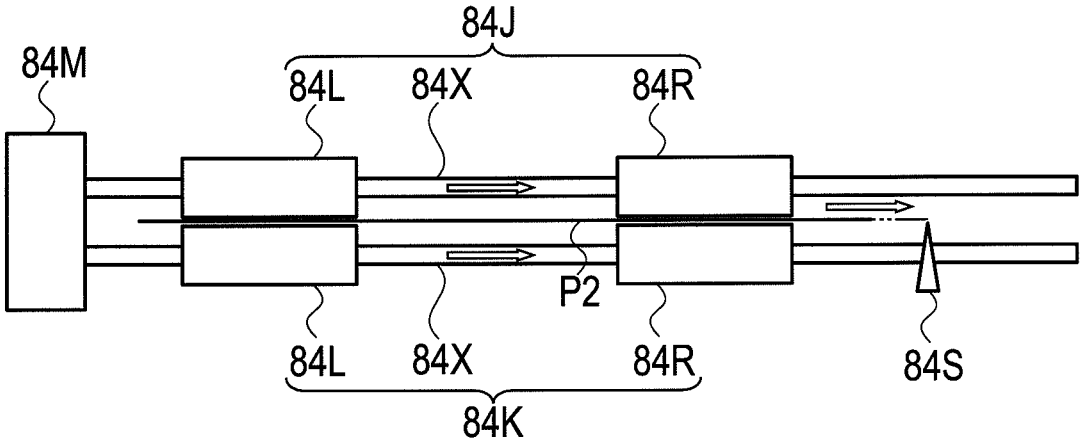
FIG. 4B is a schematic diagram of the sealed letter formation system according to an embodiment of the present invention, when seen from the conveying direction of the envelope sheet, showing that the envelope sheet is positioned in the conveyance perpendicular direction.
Figure 5A:
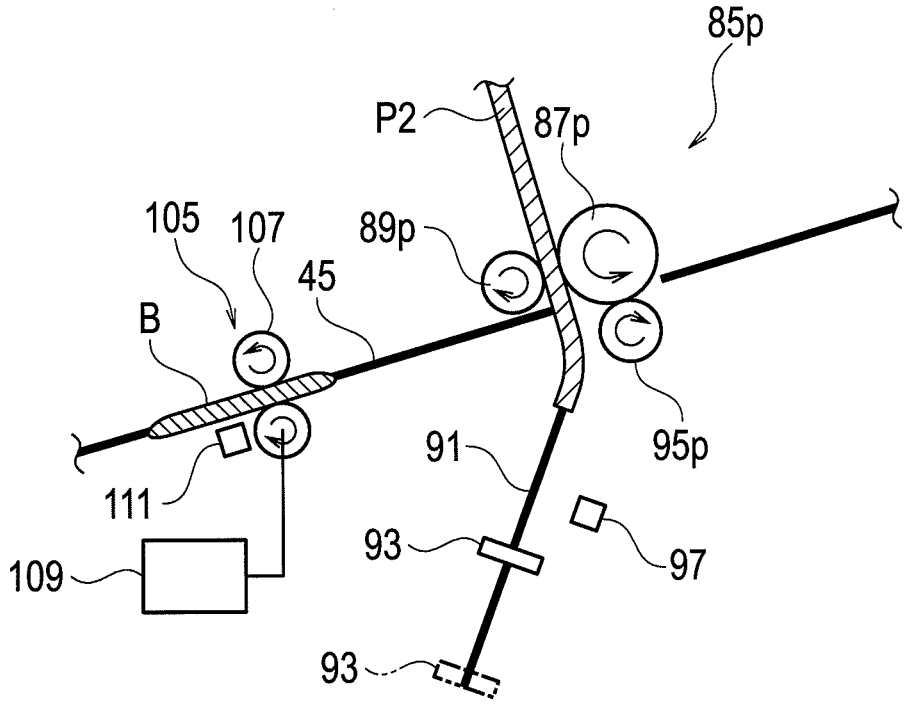
FIG. 5A is a side cross-sectional view explaining an operation when a content is about to be inserted into an envelope in the sealed letter formation system according to an embodiment of the present invention.
Figure 5B:
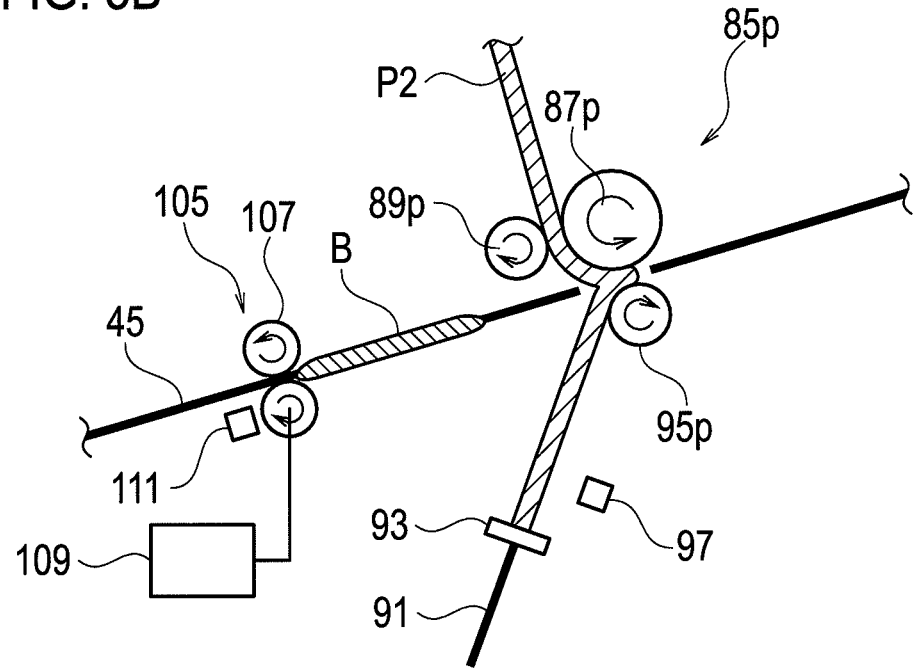
FIG. 5B is a side cross-sectional view explaining operation when the content is about to be inserted into an envelope in the sealed letter formation system according to an embodiment of the present invention.
Figure 6:
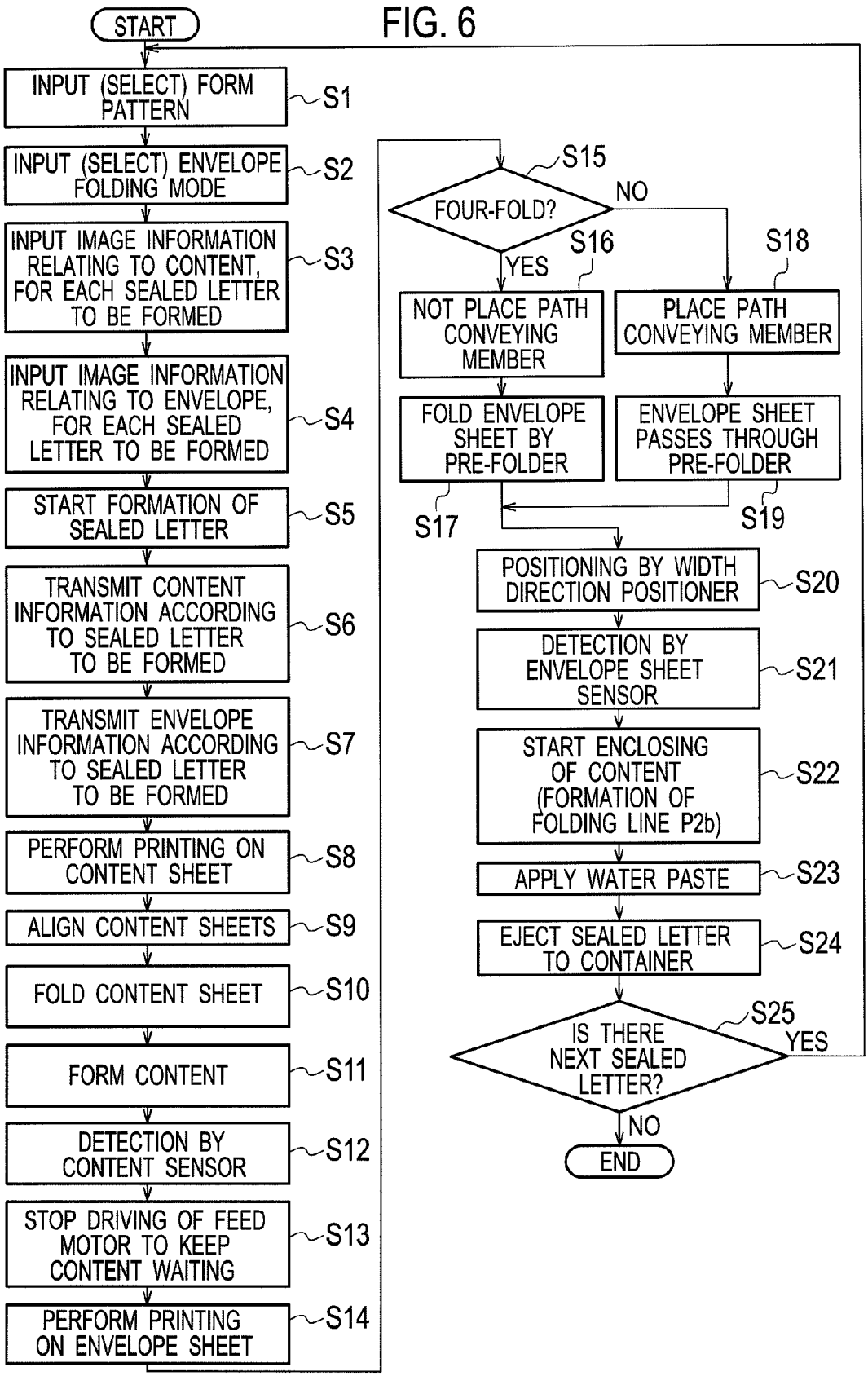
FIG. 6 is a flowchart explaining the operation of the sealed letter formation system according to an embodiment of the present invention.

FIG. 1 is a schematic front view of a sealed letter formation system according to an embodiment of the present invention (referred to as the present embodiment in the following), explaining that a content sheet is sealed in an envelope sheet. FIG. 2 is a control block diagram of the sealed letter formation system according to the present embodiment. FIG. 3 is a schematic side view showing an axial positioning driver of the sealed letter formation system according to the present embodiment. FIGS. 4A and 4B are schematic diagrams, when seen from the plane of the envelope sheet and from the conveying direction of the envelope sheet, respectively showing that the envelope sheet is positioned in the conveyance perpendicular direction in the sealed letter formation system according to the present embodiment. FIGS. 5A and 5B are side cross-sectional views, respectively explaining an operation when a content is about to be inserted into an envelope in the sealed letter formation system according to the present embodiment. FIGS. 5A and 5B schematically show the content and the envelope sheet. FIG. 6 is a flowchart explaining the operation of the sealed letter formation system according to the present embodiment.

As shown in FIG. 1, a sealed letter formation system 1 of the present embodiment has an image formation device 3 and an enclosing and sealing device 5. The sealed letter formation system 1 performs printing on a plurality of content sheets P1 and envelope sheets P2, and forms contents B and envelopes E respectively from the plurality of printed content sheets P1 and envelope sheets P2 so that the contents B are enclosed in the envelopes E, and whereby sealed letters M are formed. In other words, the sealed letter formation system 1 includes a combination of the image formation device 3 which performs printing on a plurality of content sheets P1 and envelope sheets P2, and the enclosing and sealing device (sealed letter formation device) 5 provided adjacent to the image formation device 3. The enclosing and sealing device 5 forms sealed letters M by forming contents B and envelopes E respectively from the plurality of printed content sheets P1 and envelope sheets P2 so that the contents B are enclosed in the envelopes E.

(Image Formation Device)

The image formation device 3 includes an image formation device housing 7 (referred to as the device housing 7 as appropriately in the following). The device housing 7 is provided therein with an ink-jet printing unit 9 which performs printing on the content sheet P1 and the envelope sheet P2 based on image data (content image data and envelope image data). The printing unit 9 has a plurality of line-type ink heads 11A, 11B, 11C, and 11D which discharge black, cyan, magenta, and yellow ink, respectively. The device housing 7 is provided therein with a loop-shaped printed matter conveying path 13 so as to surround the printing unit 9, for conveying the content sheet P1 and the envelope sheet P2.

Under the printing unit 9 in the device housing 7, a plurality of content sheet feeders 15 which sequentially feeds the content sheets P1 toward the printing unit 9 (toward the printed matter conveying path 13) is vertically provided in a stepwise manner. Each content sheet feeder 15 has a paper feed tray 17 on which a plurality of the content sheets P1 is stacked.

A sheet conveying path 21 for conveying the content sheet P1 toward the printing unit 9 is provided at the left side in the device housing 7 (see FIG. 1). The sheet conveying path 21 has a plurality of branched parts 21*a*. An end of each branched part 21*a* of the sheet conveying path 21 is connected to a corresponding content sheet feeder 15. The downstream end of the sheet conveying path 21 in the conveying direction is connected to the printed matter conveying path 13.

An envelope sheet feeder 23 which feeds the envelope sheets P2 toward the printing unit 9 (toward the printed matter conveying path 13) is provided at the left side of the device housing 7 (see FIG. 1). The envelope sheet feeder 23 has a paper feed tray 25 on which a plurality of envelope sheets P2 is stacked. A sheet conveying path 29 for conveying the envelope sheet P2 toward the printing unit 9 is provided at the left side in the device housing 7 (see FIG. 1). The upstream end of the sheet conveying path 29 in the conveying direction is connected to the envelope sheet feeder 23. The downstream end of the sheet conveying path 29 in the conveying direction is connected to the printed matter conveying path 13.

A cassette 31 which temporarily contains the content sheets P1 and the envelope sheets P2 is provided at the upper left side of the printed matter conveying path 13 (see FIG. 1). A switchback conveying path 33 for turning the content sheets P1 and the envelope sheets P2 inside out and conveying them toward the printing unit 9 is provided extending from the left side in the device housing 7 to inside the cassette 31 (see FIG. 1). The entrance and exit of switchback conveying path 33 can be connected to or blocked from the printed matter conveying path 13 according to an operation of a switchback flapper (not shown).

The image formation device 3 is provided with a communication conveying path 35 for conveying the content sheet P1 and the envelope sheet P2 fed out from the printed matter conveying path 13 toward the enclosing and sealing device 5. The upstream end of communication conveying path 35 in the conveying direction can be connected to or blocked from the printed matter conveying path 13 according to an operation of a communication flapper (not shown).

An image formation controller 37 is provided at an appropriate position in the device housing 7. The image formation controller 37 controls the operations of the printing unit 9, the content sheet feeder 15, the envelope sheet feeder 23, and the like. In addition, the image formation controller 37 has a memory which stores a control program or the like relating to image formation, and a CPU which executes the control program relating to image formation. An operation panel 39 is provided at the upper part of the device housing 7. The operation panel 39 or a PC screen 40 of a PC having a printer driver installed therein (the screen of the PC connected to the outside; see FIG. 2), is able to input content dimensions as information relating to the content B, and to input form patterns as information relating to the envelope E, and is electrically connected to the image formation controller 37 and an enclosing and sealing controller 119. The sealed letter formation system 1 is configured so as to allow input of information relating to the content B and the envelope E via the PC screen 40, and to allow input of information relating to the content B and the envelope E from the operation panel 39. It may also be configured so that a form pattern detection result 38 (see FIG. 2) is input to the enclosing and sealing controller 119.

(Enclosing and Sealing Device)

As shown in FIG. 1, the enclosing and sealing device 5 in the sealed letter formation system 1 includes an enclosing and sealing device housing 41 (referred to as device housing 41 as appropriate in the following). A container (ejector) 42 which contains the sealed letter M ejected from an envelope conveying path 49 described below is provided at the upper part of device housing 41. A part of the device housing 41 is dented at the upper part of the device housing 41, and the container 42 is formed by a fence 42*f* vertically installed in this part.

The device housing 41 is provided therein with an introduction conveying path 43 for conveying the printed content sheet P1 and the envelope sheet P2 fed out from the communication conveying path 35 (image formation device 3) toward the right side of FIG. 1. The upstream end of the introduction conveying path 43 in the conveying direction is connected to the downstream end (tip end) of the communication conveying path 35.

(Content Sheet Folding Mechanism)

The device housing 41 is provided therein with a content sheet conveying path 45 for conveying the printed content sheet P1 or the like (including the content B). The upstream end (base end) of the content sheet conveying path 45 can be connected to or blocked from the downstream end of the introduction conveying path 43 in the conveying direction according to an operation of an enclosing and sealing flapper.

An aligner 51 is provided midway in the content sheet conveying path 45. The aligner 51 collects and aligns the plurality of printed content sheets P1 fed out from the introduction conveying path 43. The aligner 51 has an alignment gate (waiting gate) 53 which keeps the plurality of printed content sheets P1 waiting. The alignment gate 53 can switch the content sheet conveying path 45 between an open state and a closed state.

A content formation unit 55 is provided at the exit side (downstream) of the aligner 51 of the content sheet conveying path 45. The content formation unit 55 folds the plurality of aligned content sheets P1 (referred to as the content sheet P1 as appropriate in the following) fed out from the aligner 51 to form the content B. A specific configuration of the content formation unit 55 will be described below.

A main folding roller 57 is provided as a drive roller at the exit side of the aligner 51. A feed-in roller 59 which feeds in the content sheet 21 from the content sheet conveying path 45 is provided as a driven roller at a position adjacent to the main folding roller 57 in the device housing 41. A guide board 61 which guides the content sheet P1 fed in by the main folding roller 57 and the feed-in roller 59 is provided on the downstream side of the main folding roller 57 in the conveying direction in the device housing 41. The guide board 61 is provided with a butt member 63 which butts against the tip of the content sheet P1 to provide sagging in the vicinity of a folding line P1*a* of the content sheet P1. The butt member 63 is position-adjustable along the guide board 61 by driving of an appropriate first position-adjusting motor (not shown). An intermediate roller 65 is provided as a driven roller adjacent to the main folding roller 57 in the device housing 41. The intermediate roller 65 cooperates with the main folding roller 57 to fold the content sheet P1 along the folding line P1*a*, with the vicinity of the folding line P1*a* of the content sheet P1 being sagged.

The device housing 41 is provided therein with a guide board 67 which guides the content sheet P1 folded by the main folding roller 57 and intermediate roller 65. The guide board 67 is provided with a butt member 69 which butts against the tip of the content sheet P1 to cause sagging in the vicinity of a folding line P1*b* of the content sheet P1. The butt member 69 is position-adjustable along the guide board 67 by driving of an appropriate second position-adjusting motor (not shown). A feed-out roller 71 is provided as a driven roller at a position adjacent to the main folding roller 57 and facing the intermediate roller 65. The feed-out roller 71 cooperates with the main folding roller 57 to feed out the content sheet P1 toward the content sheet conveying path 45 while folding it along the folding line P1*b*, with the vicinity of folding line P1*b* of the content sheet P1 being sagged.

An envelope sheet conveying path 47 for conveying the printed envelope sheet P2 is provided at the upper part of the content sheet conveying path 45 in the device housing 41. The upstream end of the envelope sheet conveying path 47 in the conveying direction can be connected to or blocked from the downstream end of the introduction conveying path 43 by the operation of the above-mentioned enclosing and sealing flapper.

(Envelope Sheet Folding Mechanism)

The downstream end of the content sheet conveying path 45 is confluent with the downstream end of the envelope sheet conveying path 47. The envelope conveying path 49 for conveying the sealed letter M in a state that the content B is in the middle of being enclosed or is already enclosed is provided downstream (at the exit side) of the confluent portion of the content sheet conveying path 45 and the envelope sheet conveying path 47. The envelope conveying path 49 extends over the device housing 41.

(Pre-folder)

A pre-folder 73 is provided midway in the envelope sheet conveying path 47. When the folding mode of the envelope E is set to the four-fold mode, the pre-folder 73 performs pre-folding of the printed envelope sheet P2 (referred to as the envelope sheet P2 as appropriate in the following) fed out from the communication conveying path 35. The place to be pre-folded is a portion where the envelope sheet P2 is first folded before the content is enclosed therein. The pre-folder 73 is provided with a switcher 74 which feeds the envelope sheet P2 from the pre-folder 73 without folding the envelope sheet P2 by the pre-folder 73 when the folding mode of the envelope E is set to the three-fold mode. The switcher 74 is controlled by a drive control unit 124 described below.

As shown in FIG. 3, a main folding roller 75 is provided in the pre-folder 73 as a drive roller. A feed-in roller 77 which cooperates with the main folding roller 75 to feed in the envelope sheet P2 from the envelope sheet conveying path 47 is provided as a driven roller at a position adjacent to the main folding roller 75. The pre-folder 73 is provided with a guide board 79 which guides the envelope sheet P2 fed in by the main folding roller 75 and the feed-in roller 77. The guide board 79 is provided with a butt member 81 which butts against the tip of the envelope sheet P2 to cause sagging in the vicinity of a folding line P2*a* of the envelope sheet P2. The butt member 81 is position-adjustable along the guide board 79 by driving of an appropriate third position-adjusting motor (not shown). A feed-out roller 83 is provided as a driven roller at a position adjacent to the main folding roller 75. The feed-out roller 83 is configured so as to feed out the envelope sheet P2 toward the envelope sheet conveying path 47 while folding it along the folding line P2*a* in cooperation with the main folding roller 75, with the vicinity of the folding line P2*a* of the envelope sheet P2 being sagged.

The switcher 74 provided in the pre-folder 73 has a path conveying member 76 which guides the fed-in envelope sheet P2 to be directly fed out, and a holder 78 (see FIG. 2) which holds the path conveying member 76. The holder 78 rotatably holds the path conveying member 76 so as to allow switching between placing and not placing the path conveying member 76 in the conveying path in the pre-folder 73. Switching between placing and not placing the path conveying member 76 by the holder 78 is controlled by the drive control unit 124.

Placing the path conveying member 76 in the conveying path according to such a configuration prevents the envelope sheet sandwiched between the main folding roller 75 and the feed-in roller 77 from being conveyed to the guide board 79, and causes the envelope sheet to be sandwiched between the main folding roller 75 and the feed-out roller 83 and fed out from the pre-folder 73. When the path conveying member 76 is not placed in the conveying path, the envelope sheet sandwiched between the main folding roller 75 and the feed-in roller 77 is guided to the guide board 79 and the tip of the envelope sheet butts against the butt member 81 as described above. Therefore, when the folding mode of the envelope E is set as the three-fold mode, the envelope sheet P2 is guided by the path conveying member 76 and fed out from the pre-folder 73 without being folded by the pre-folder 73. When the folding mode of the envelope E is set as the four-fold mode, the envelope sheet P2 is initially folded by the pre-folder 73 and fed out from the pre-folder 73.

Although an example has been described in the above explanation in which the switcher 74 is provided in the pre-folder 73, the switcher 74 may be provided separately from the pre-folder 73. For example, a detour line may be provided which branches at the upstream side of the pre-folder 73 in the conveying direction and connects to the downstream side of the pre-folder 73 in the conveying direction. When the folding mode of the envelope E is set as the four-fold mode, the envelope sheet P2 is forwarded to the pre-folder 73. When the folding mode of the envelope E is set as the three-fold mode, the envelope sheet P2 is conveyed along the detour line and conveyed to the upstream side of a width direction positioner 84 described below in the conveying direction.

(Width Direction Positioner of Envelope Sheet)

As shown in FIGS. 3 and 4, a width direction positioner 84 which performs positioning of the envelope sheet P2 in a conveyance perpendicular direction X (direction perpendicular to the conveying direction of envelope sheets) is provided on the downstream side of the pre-folder 73 in the conveying direction midway in the envelope sheet conveying path 47.

The width direction positioner 84 has a reception sensor 84A which detects the tip of the envelope sheet P2 and detects that the envelope sheet P2 has reached, and a pair of feeding members 84J and 84K provided downstream of the reception sensor 84A to sandwich the envelope sheet P2 from both sides and feed it out to a former stage envelope formation unit 85*p* described below. Each of the feeding members 84J and 84K includes two registration rollers 84L and 84R, and a rotation axis 84X axially supporting the registration rollers 84L and 84R in a manner penetrating through the center of the registration rollers 84L and 84R. In the present embodiment, the registration rollers 84L and 84R are respectively located at either side of the envelope sheet P2 in the conveying direction centerline. The envelope sheer P2 is conveyed in a manner being sandwiched between the pair of registration rollers 84L and 84R.

The width direction positioner 84 has an axial positioning driver 84M (see also FIG. 2) which transfers the rotation axis 84X of each of the feeding members 84J and 84K in the axial direction (conveyance perpendicular direction X), and a detection sensor 84S which detects that a side edge P2E of the envelope sheet P2 has reached a predetermined position. Control of the axial positioning driver 84M is performed by the drive control unit 124.

Transferring the feeding members 84J and 84K in the axial direction with the envelope sheet P2 being sandwiched by the registration rollers 84L and 84R according to such a configuration allows the envelope sheet P2 to be transferred in the conveyance perpendicular direction X. When the detection sensor 84S detects that the side edge P2E of the envelope sheet P2 has reached a prescribed position, the drive control unit 124 stops transfer of the rotation axis 84X by the axial positioning driver 84M.

In the present embodiment, a single detection sensor 84S is provided to detect the side edge P2E of the envelope sheet P2. When conveying the envelope sheet P2 to the width direction positioner 84, the enclosing and sealing device 5 conveys the envelope sheet P2 which has been preliminarily displaced by a length considering unevenness of positions, in the conveyance perpendicular direction X on the side where the detection sensor 84S is not provided. Accordingly, the side edge P2E of the envelope sheet P2 can be reliably detected by transferring the envelope sheet P2 together with the registration rollers 84L and 84R toward the side where the detection sensor 84S is provided.

The width direction positioner 84 has a home position sensor 84H for returning the registration rollers 84L and 84R to the home position. According to this configuration, after the axial positioning driver 84M has transferred the registration rollers 84L and 84R and fed out the envelope sheet P2, the width direction positioner 84 transfers the rotation axis 84X to return the registration rollers 84L and 84R to the home position.

Deflection of the envelope sheet P2 caused by reaching of the tip of the envelope sheet P2 to the registration rollers 84L and 84R initiates skew correction of the envelope sheet P2. In other words, the envelope sheet P2 deflects when the tip of the envelope sheet P2 which has been conveyed in a skewed manner butts against one of the registration rollers 84L and 84R positioned at the home position with the rotation stopped, which causes the tip of the envelope sheet P2 to butt against the registration rollers 84L and 84R.

(Folding Mechanism to Enclose Content)

The former stage envelope formation unit 85*p* is provided at the confluent portion of the content sheet conveying path 45 and the envelope sheet conveying path 47. The envelope formation unit 85*p* performs the first half of the process of folding the envelope sheet P2 fed out from the pre-folder 73 to form the envelope E. A specific configuration of envelope formation unit 85 is described in the following.

The envelope formation unit 85 includes the former stage envelope formation unit 85*p* and a latter stage envelope formation unit 85*q* provided on the downstream side of the former stage envelope formation unit 85*p* in the conveying direction.

The former stage envelope formation unit 85*p* is provided in close proximity to the exit side of the width direction positioner 84. A main folding roller 87*p* is provided as a drive roller. A feed-in roller 89*p* which cooperates with the main folding roller 87*p* to feed in the envelope sheet P2 from the envelope sheet conveying path 47 is provided as a driven roller at a position adjacent to the main folding roller 87*p*. The former stage envelope formation unit 85*p* is provided with a guide board 91 which guides the envelope sheet P2 fed in by the main folding roller 87*p* and feed-in roller 89*p*. The guide board 91 is provided with a butt member 93 which butts against the tip of the envelope sheet P2 to cause sagging in the vicinity of the folding line P2*b* of the envelope sheet P2. The butt member 93, having an appropriate fourth position-adjusting motor (not shown), is position-adjustable (see FIG. 5) along the guide board 91 by driving of the fourth position-adjusting motor. The former stage envelope formation unit 85*p* is provided with a feed-out roller 95*p*. The feed-out roller 95*p* folds the envelope sheet P2 along the folding line P2*b* in cooperation with the main folding roller 87*p*, with the vicinity of the folding line P2*b* of the envelope sheet P2 being sagged.

An envelope sheet sensor 97 such as a reflective photoelectric sensor is provided in the vicinity of the guide board 91 in the device housing 41. The envelope sheet sensor 97 is configured to detect that the envelope sheet P2 has come into proximity to the butt member 93, in other words, the start timing of folding the envelope sheet P2 by the former stage envelope formation unit 85*p* (in cooperation with the main folding roller 87*p* and feed-out roller 95*p*).

The latter stage envelope formation unit 85*q* is provided on the downstream side of the former stage envelope formation unit 85*p* in the conveying direction. The latter stage envelope formation unit 85*q* is provided with a main folding roller 87*q* as a drive roller. A feed-in roller 89*q* which feeds in the envelope sheet P2 from the envelope conveying path 49 in cooperation with the main folding roller 87*q* is provided as a driven roller at a position adjacent to the main folding roller 87*q*. The latter stage envelope formation unit 85*q* is provided with a guide board 99 which guides the envelope sheet P2 folded by the main folding roller 87*q* and the feed-in roller 89*q*. The guide board 99 is provided with a butt member 101 which butts against the tip of the envelope sheet P2 to cause sagging in the vicinity of the folding line P2*c* of the envelope sheet P2. The butt member 101 has an appropriate fifth position-adjusting motor (not shown), and the butt member 101 is position-adjustable along the guide board 99 by driving of the fifth position-adjusting motor. A feed-out roller 95*q* is rotatably provided at a position adjacent to the main folding roller 87*q*. The feed-out roller 95*q* is configured to feed out the envelope sheet P2 toward the downstream of the conveying direction while folding it along the folding line P2*c* in cooperation with the main folding roller 87*q*, with the vicinity of the folding line P2*c* of the envelope sheet P2 being sagged.

A contents conveyer 105 is provided at the entrance side (upstream of the conveying direction) of the former stage envelope formation unit 85*p* midway in the content sheet conveying path 45. The content conveyer 105 feeds out the content B fed out from the content formation unit 55 toward the former stage envelope formation unit 85*p* so as to be enclosed in the envelope sheet P2 which is being folded along the folding line P2*b*. The content conveyer 105 has a feed roller pair 107 which feeds out the content B toward the former stage envelope formation unit 85*p*. The feed roller pair 107 is rotatable by driving of an appropriate feed motor 109 (see FIG. 5). A content sensor 111 such as a reflective photoelectric sensor is provided in the vicinity of the feed roller pair 107 in the device housing 41. The content sensor 111 detects that the tip of content B has approached the former stage envelope formation unit 85*p*.

The enclosing and sealing device 5 has a water paste application unit 88 (see FIG. 2) which applies water paste to the envelope sheet P2 when folding the envelope sheet P2 to enclose a content. Here, pressure paste may be used in place of water paste, which generates an adhesive force when pressure-contacted to each other.

A sealing unit 113 is provided midway in the envelope conveying path 49. The sealing unit 113 seals the envelope E fed out from the latter stage envelope formation unit 85*q*. The sealing unit 113 has a sealing roller pair 115 which sandwiches and presses the envelope E. The sealing roller pair 115 is rotatable by driving of an appropriate sealing motor (not shown). Here, the envelope E is sandwiched and pressed by the sealing roller pair 115, and thereby is sealed by an adhesion effect of the paste preliminarily applied to the envelope sheet P2. A sealed letter ejector 117 which ejects the sealed letter M fed out from the envelope conveying path 49 is provided at the exit side (downstream end) of the envelope conveying path 49 in the upper part of the device housing 41.

(Enclosing and Sealing Controller)

As shown in FIG. 2, the enclosing and sealing controller 119 is provided at an appropriate position in the device housing 41. The enclosing and sealing controller 119 controls the operations of the aligner 51, the content formation unit 55, the pre-folder 73, the width direction positioner 84, the envelope formation unit 85, the water paste application unit 88, the content conveyer 105, the sealing unit 113, or the like. The enclosing and sealing controller 119 includes a memory which stores a control program or the like relating to enclosing and sealing and a CPU which executes the control program relating to enclosing and sealing. To the enclosing and sealing controller 119, electrically connected are the image formation controller 37, the PC screen 40, the envelope sheet sensor 97, and the content sensor 111.

The memory of the enclosing and sealing controller 119 has a function as a storage unit 120 which stores the folding mode of the envelope E. The CPU of the enclosing and sealing controller 119 has a function as the drive control unit 124 and a function as a feed control unit 127.

The folding mode storage unit 120 stores form patterns (including length, width, etc.) as information relating to the content B, and also stores which instruction of three-fold mode or four-fold mode has been input as the folding mode of the envelope E.

The drive control unit 124 controls the operations of the holder 78 and the axial positioning driver 84M, as described above. The drive control unit 124 drives the first to fifth position-adjusting motors to perform position-adjusting of the butt members 63, 69, 81, 93, and 101.

The feed control unit 127 controls the feed motor 109 of the content conveyer 105 so as to feed out the content B toward the envelope formation unit 85 in accordance with a predetermined feed-timing, using an input of a detection signal from the envelope sheet sensor 97 as a trigger (reference). When the detection signal from the content sensor 111 is input to the enclosing and sealing controller 119, the feed control unit 127 controls so as to stop driving of the feed motor 109 of the content conveyer 105.

(Operation, Function, and Effect)

An operation of the sealed letter formation system 1 will be described together with the function and effect of the present embodiment. FIG. 6 is a flowchart explaining an operation of the sealed letter formation system 1 of the present embodiment.

The form pattern as information relating to the envelope E, the folding mode of the envelope E (three-fold mode/four-fold mode), the image information relating to the content B, and the image information relating to the envelope E are input (steps S1 to S4 in FIG. 6), for each sealed letter M to be formed, to the image formation controller 37 by an input operation on the PC screen 40 (using an application of the PC). Instead of selecting, the user may input a pattern figure. In addition, input can be performed via the operation panel 39 instead of the PC screen 40.

When formation of the sealed letter M is actually started (step S5) after step S4 has been completed, information (information data) relating to the content B and information (information data) relating to the envelope E in accordance with the sealed letter M to be formed are transmitted (input) from the image formation controller 37 to the enclosing and sealing controller 119 (steps S6 and S7).

After step S7 has been completed, a plurality of content sheets P1 is sequentially fed from the content sheet feeder 15 toward the printing unit 9 (toward the printed matter conveying path 13) via the sheet conveying path 21. While the sequentially fed content sheets P1 are being conveyed along the printed matter conveying path 13, the printing unit 9 sequentially performs printing on the plurality of content sheets P1 based on the content image data (step S8). Here, the printing unit 9 can perform duplex printing on the plurality of content sheets P1 by circularly conveying the content sheets P1 via the switchback conveying path 33.

After S8 has been completed, the plurality of printed content sheets P1 is sequentially fed toward the introduction conveying path 43 (toward the enclosing and sealing device 5) via the communication conveying path 35. The plurality of content sheets P1 is then conveyed along the introduction conveying path 43 and the content sheet conveying path 45, and sequentially fed out toward the alignment gate 53 which is in the closed state. The plurality of content sheets P1 is then aligned by the aligner 51 (step 9).

After step S9 has been completed, the aligned content sheets P1 are conveyed toward the content formation unit 55 by switching the alignment gate 53 from the closed state to the open state to feed them out toward the downstream of the conveying direction. The content sheets P1 are then fed in from the content sheet conveying path 45 by cooperation of the main folding roller 57 and the feed-in roller 59 in the content formation unit 55, and the content sheets P1 are folded (step S10). As a result, the content B is formed (step S11) from the aligned content sheets P1 (the plurality of printed content sheets), and fed out from the content formation unit 55.

Subsequently, the content B is conveyed along the content sheet conveying path 45 and forwarded in between the rotating feed roller pair 107. Then, as shown in FIG. 5A, when the content sensor 111 detects that the content B has approached the former stage envelope formation unit 85*p* (step S12), in other words, a detection signal from the content sensor 111 is input to the enclosing and sealing controller 119, the feed control unit 127 (CPU of the enclosing and sealing controller 119) stops driving of the feed motor 109. Thereby, the content B can be kept waiting at the entrance side of the former stage envelope formation unit 85*p* (step S13).

After step S13 has been completed, the envelope sheet feeder 23 sequentially feeds the envelope sheet P2 toward the printing unit 9 (toward the printed matter conveying path 13) via the sheet conveying path 29. While the envelope sheet P2 is being conveyed along the printed matter conveying path 13, the printing unit 9 performs printing on the envelope sheet P2 based on the envelope image data (step S14).

After step S14 has been completed, the printed envelope sheet P2 is fed out toward the introduction conveying path 43 (toward the enclosing and sealing device 5) via the communication conveying path 35. Next, the envelope sheet P2 is conveyed toward the pre-folder 73 along the introduction conveying path 43 and the envelope sheet conveying path 47. It is then determined whether or not the instructed folding mode of the envelope E is the four-fold mode (step S15).

If the four-fold mode has been instructed, the path conveying member 76 is not placed in the conveying path in the pre-folder 73 by the holder 78, based on a control instruction from the drive control unit 124 (step S16). As a result, the envelope sheet P2 is folded by the pre-folder 73, and whereby the initial folding is performed (step S17). If, on the other hand, the three-fold mode has been instructed, the path conveying member 76 is placed in the conveying path in the pre-folder 73, based on the control instruction from the drive control unit 124 (step S18). As a result, the envelope sheet P2 is fed out from the pre-folder 73 via the path conveying member 76 without being folded (step S19).

Regardless of whether the folding mode of the envelope E is set to the three-fold mode or the four-fold mode, the envelope sheet P2 fed out from the pre-folder 73 is fed to the width direction positioner 84, where positioning along the conveyance perpendicular direction X is performed (step S20), and fed out to the former stage envelope formation unit 85*p*.

Then, when the envelope sheet sensor 97 detects the envelope sheet P2 in the former stage envelope formation unit 85*p* (step S21), the content B is fed out from the content conveyer 105 to the former stage envelope formation unit 85*p*, and enclosing of the content B is started (step S22) (see FIG. 5B).

In this occasion, the water paste is applied to a predetermined position of the envelope sheet (step S23), and the sealed letter M is formed and ejected to the container 42 (step S24).

After step S24 has been completed, the process flow returns to step S1 to perform the processes of step S1 and subsequent steps if there exists a next sealed letter M to be formed (step S25). If some of step S1 and subsequent steps have a same condition, the process flow may return to an intermediate step to continue the processing. For example, if steps S1 to S4 have a same condition when forming a next sealed letter, the process flow may return to step S5 and execute step S5 and subsequent steps.

The operation of the sealed letter formation system 1 is not limited to the order of the above-mentioned steps and the order of execution may be changed as appropriate.

According to the present embodiment, as described above, if the folding mode of the envelope E is instructed to be the three-fold mode, in the pre-folder 73, by switching between placing and not placing the path conveying member 76 in the conveying path by the switcher 74, the envelope sheet P2 is guided by the path conveying member 76 and fed out from the pre-folder 73 without being folded by the pre-folder 73. If the folding mode of the envelope E is instructed to be the four-fold mode, the envelope sheet P2 is subject to the initial folding by the pre-folder 73. In other words, after having been initially folded by the pre-folder 73 in the case of four-fold mode, the envelope sheet P2 is conveyed to the width direction positioner 84 and positioned in the width direction (conveyance perpendicular direction X) of the envelope sheet P2.

Therefore, an envelope sheet which is relatively long in the conveying direction with the folding mode of the envelope E being the four-fold mode is conveyed to the width direction positioner 84 in a slightly shortened state due to the initial folding, and positioned in the conveyance perpendicular direction X. Accordingly, since the space required for the width direction positioner 84 can be significantly reduced in comparison with conventional ones, the enclosing and sealing device 5 can be downsized. In addition, since positioning in the conveyance perpendicular direction X becomes easier, the positioning can be performed in a shorter time, which leads to an enhanced productivity. This brings about a particularly significant effect when the room (error tolerance range) in the width direction between the sealed envelope sheet P2 and the content B is small. In addition, when installing the sealed letter formation system 1, strict positioning between the image formation device 3 and the enclosing and sealing device 5 need not be performed, and therefore the time required for installation work can be significantly shortened.

The width direction positioner 84 also performs skew correction of the envelope sheet P2 due to sagging of the envelope sheet P2 caused by the tip of the envelope sheet P2 reaching the registration rollers 84L and 84R.

When folding the envelope sheet in the three-fold mode with the configuration in which the switcher 74 is provided in the pre-folder 73, the envelope sheet P2 conveyed to the pre-folder 73 is fed out without being folded by the pre-folder 73. Accordingly, the switcher 74 can be significantly downsized.

Since switching between whether or not to fold the envelope sheet P2 by the pre-folder 73 is allowed by switching between placing and not placing the path conveying member 76 by the holder 78 provided in the switcher 74, the switcher 74 can be configured to be small and simple. This is particularly effective in case of making the length of the envelope sheet P2 in the conveying direction after being folded by the pre-folder 73 when the folding mode of the envelope E is the four-fold mode, equal to the length of the envelope sheet P2 in the conveying direction without being folded by the pre-folding unit 73 when the folding mode of the envelope E is the three-fold mode.

When the detection sensor 84S detects that the side edge P2E of the envelope sheet P2 has reached a prescribed position when transferring the envelope sheet P2 in the conveyance perpendicular direction X by transferring the registration rollers 84L and 84R in the axial direction (conveyance perpendicular direction X) by the axial positioning driver 84M, the width direction positioner 84 stops transfer of the registration rollers 84L and 84R. Accordingly, positioning of the envelope sheet P2 in the conveyance perpendicular direction X can be performed with a simple mechanism in a short time.

What is claimed is:

1. A sealed letter formation system that folds an envelope sheet while enclosing a content, provides an envelope having the content enclosed therein, and seals the envelope, the system comprising:

a folder that that is configured to fold a first envelope fold of the envelope sheet before the content is placed on the envelope sheet;

a positioner provided downstream of the folder in a conveying direction of the envelope sheet to position the envelope sheet by adjusting displacement of the envelope sheet in a conveyance perpendicular direction perpendicular to the conveying direction of the envelope sheet before placing the content on the envelope sheet and subsequent folding of the envelope sheet to enclose the content; and a switcher that is configured to be selectively placed in a conveying path of the envelope sheet so as to prevent the folder from folding the first envelope fold and to feed the unfolded envelope sheet to the positioner.

2. The sealed letter formation system according to claim 1, wherein the positioner includes:

a feeding member that conveys the envelope sheet;

a positioning driver that transfers the feeding member in the conveyance perpendicular direction; and a detector that detects that a side edge of the envelope sheet along the conveying direction of the envelope sheet has reached a predetermined position, wherein when the detector detects that the side edge of the envelope sheet has reached the predetermined position, the transfer of the feeding member by the positioning driver is stopped.

3. The sealed letter formation system according to claim 1, wherein when a length of the envelope sheet in the conveying direction is smaller than a predetermined value, the switcher is placed in the conveying path, prevents the folder from folding the first envelope fold, and feeds the unfolded envelope sheet to the positioner.

* * * * *